US011208789B2

(12) United States Patent
Obrist et al.

(10) Patent No.: US 11,208,789 B2
(45) Date of Patent: Dec. 28, 2021

(54) ADJUSTABLE WATER OUTLET

(71) Applicant: OBLAMATIK AG, Chur (CH)

(72) Inventors: Roland Obrist, Scharans (CH); Daniel Knupfer, Trimmis (CH)

(73) Assignee: OBLAMATIK AG, Chur (CH)

( * ) Notice: Subject to any disclaimer, the term of this patent is extended or adjusted under 35 U.S.C. 154(b) by 0 days.

(21) Appl. No.: 16/638,977

(22) PCT Filed: Aug. 24, 2017

(86) PCT No.: PCT/EP2017/071363
§ 371 (c)(1),
(2) Date: Feb. 13, 2020

(87) PCT Pub. No.: WO2019/037859
PCT Pub. Date: Feb. 28, 2019

(65) Prior Publication Data

US 2020/0362545 A1 Nov. 19, 2020

(51) Int. Cl.
*F16L 5/00* (2006.01)
*E03B 7/07* (2006.01)

(52) U.S. Cl.
CPC ..... *E03B 7/07* (2013.01)

(58) Field of Classification Search
CPC . E03B 7/07; E03B 7/075; E03B 7/072; E03B 9/025; E03B 9/04; Y10T 137/698
See application file for complete search history.

(56) References Cited

U.S. PATENT DOCUMENTS 2,754,137 A 7/1956 Gine et al.
2,847,027 A * 8/1958 Kumpman ..... F16K 11/18 137/597
3,880,183 A * 4/1975 Humpert ..... F16K 11/0445 4/678

(Continued)

FOREIGN PATENT DOCUMENTS

CN 203891135 U 10/2014
DE 102007008537 A1 9/2008

(Continued)

OTHER PUBLICATIONS

International Preliminary Report on Patentability for corresponding PCT application No. PCT/EP2017/071363, dated Feb. 25, 2020.

(Continued)

*Primary Examiner* — Reinaldo Sanchez-Medina
(74) *Attorney, Agent, or Firm* — Notaro, Michalos & Zaccaria P.C.

(57) ABSTRACT

A water outlet for installation in a recess in a wall having an inner pipe designed as a throughflow pipe, an outer pipe designed as an outflow pipe, where the outer pipe partially surrounds the inner pipe, and a connection unit has a connection plate and a bezel where the inner pipe is arranged on the connection plate, and the bezel is arranged around the outer pipe at a distance from the connection plate, where the outer pipe is displaceable along a longitudinal axis, and a fixing means is provided, by which a previously adjusted relative position between the inner pipe and the outer pipe can be fixed, where the fixing means is arranged between the connection plate and the bezel.

9 Claims, 2 Drawing Sheets

(56) References Cited

U.S. PATENT DOCUMENTS

| | | | | |
|---|---|---|---|---|
| 6,138,716 | A * | 10/2000 | Yen | E03C 1/0404 137/801 |
| 6,615,422 | B2 * | 9/2003 | Hecker | E03C 1/0401 137/801 |
| 7,793,365 | B2 * | 9/2010 | Miura | E03C 1/0403 4/678 |
| 8,214,941 | B2 * | 7/2012 | Furseth | E03C 1/042 4/678 |
| 2005/0161087 | A1 * | 7/2005 | Brattoli | E03B 7/12 137/360 |
| 2006/0201562 | A1 * | 9/2006 | Gloor | E03C 1/0404 137/801 |

FOREIGN PATENT DOCUMENTS

| | | | |
|---|---|---|---|
| EP | 2378011 | A1 | 10/2011 |
| JP | 59-92281 | A | 5/1984 |
| JP | S5992281 | U | 6/1984 |
| JP | 4-289337 | A | 10/1992 |
| JP | H04289337 | A | 10/1992 |

OTHER PUBLICATIONS

International Search Report for corresponding PCT application No. PCT/EP2017/071363, dated May 23, 2018.

* cited by examiner

ADJUSTABLE WATER OUTLET

TECHNICAL FIELD

The present invention relates to a water outlet for installation in a recess in a wall.

PRIOR ART

Water outlets are known to which outflow pipes of different lengths can be attached in order to be able to compensate for installation-related fluctuations in distance between the wall and the washbasin, or between the wall and the location of the plughole in the washbasin. The outflow pipes are usually available in the three lengths short, medium and long. This means that a large inventory is required if all pipe lengths are to be available for every water outlet, and is impractical with regard to installation since the actual distance between the wall and the water outlet cannot be determined until the time of installation. In addition, there is the risk that none of the available pipe lengths actually has the desired length. In this case, an existing outflow pipe has to be modified, which is time-consuming and leads to additional installation costs.

DESCRIPTION OF THE INVENTION

It is an object of the present invention to provide a water outlet which can be adapted on site to the prevailing dimensions.

This object is achieved by a water outlet having the features of claim 1. Further embodiments of the water outlet are defined by the features of further claims.

A water outlet according to the invention for installation in a recess in a wall comprises an inner pipe designed as a throughflow pipe and an outer pipe designed as an outflow pipe, wherein the outer pipe at least partially surrounds the inner pipe. The water outlet further comprises a connection unit comprising a connection plate and a bezel, wherein the inner pipe is arranged on the connection plate, and wherein the bezel is arranged around the outer pipe at a distance from the connection plate. The outer pipe is displaceable along a longitudinal axis. A fixing means is provided, by which a previously adjusted relative position between the inner pipe and the outer pipe can be fixed, wherein the fixing means is arranged between the connection plate and the bezel. This design enables continuous adjustment of the distance between the front of the bezel, which is aligned substantially flush with the wall, and an outlet end of the outer pipe. The distance adjustment can be carried out on site, and no additional outflow pipes are necessary in order to be able to cover a large range of distances.

In one embodiment, the fixing means is arranged on the inner pipe or on the outer pipe, or the fixing means is arranged on the connection unit. In principle, it is possible to use any type of fixing device or mechanism that is able to prevent the relative displacement of the outer pipe with respect to the inner pipe. By way of example, a threaded bore may be provided in the outer pipe, into which a screw can be screwed and by which a pressing force can be exerted on the inner pipe in order to fix the outer pipe with respect to the inner pipe. Other clamping elements which are arranged on the outer pipe and press against the inner pipe are also possible. Alternatively, the outer pipe may be designed to be pliant and a clamping element may compress the outer pipe, as a result of which the latter clamps against the rigid inner pipe. By way of example, the outer pipe may be slit in order to make it pliant. The two parts of the outer pipe adjoining the slit may be drawn together by a screw or a clamp which can act on both sides of the slit. This design enables the installer to easily adjust the length of the outflow pipe and prevents access to the fixing means after installation. In such a design, the fixing means is located in the interior of the connection unit, which comprises a sealed housing, as a result of which the sealing effect of the fixing means plays a minor role. Alternatively, the fixing means may be arranged on the connection unit, or on the housing thereof. This makes it possible for the distance to be adjusted even after the water outlet has been assembled, but requires a sealing of the fixing means with respect to the housing.

In one embodiment, circumferential grooves are provided on the outer circumference of the inner pipe, which circumferential grooves are arranged in a manner spaced apart from one another along the longitudinal axis, wherein the fixing means can engage in the grooves. This enables a secure fixing of the inner pipe with respect to the outer pipe. By predefining the distances between two adjacent circumferential grooves, it is possible to define the settable lengths of the outflow pipe. By way of example, the distance between two adjacent circumferential grooves is 1, 2, 5 or 10 millimetres.

In one embodiment, at least one longitudinal groove is provided along the outer circumference of the inner pipe and at least one protrusion is provided on the inner circumference of the outer pipe, which protrusion can be guided in the longitudinal groove. An exact orientation of the outer pipe with respect to the inner pipe can thus be achieved. A plurality of such longitudinal grooves may be provided, which makes it possible for the outer pipe to be oriented at predetermined angles with respect to the inner pipe, and thus with respect to the connection unit. By way of example, four longitudinal grooves may be evenly distributed around the circumference of the inner pipe, which enables the outer pipe to be oriented at every 90 degrees.

In one embodiment, at least one seal is provided between the inner pipe and the outer pipe. By providing a seal, the outer diameter of the inner pipe and the inner diameter of the outer pipe need not be tolerated so precisely to one another. In other words, more play can exist between the two pipes, as a result of which less force is required in order to displace the outer pipe on the inner pipe.

In one embodiment, the outer pipe comprises a conduit pipe and a casing pipe which at least partially surrounds the conduit pipe. This design enables an optimal choice of material for both pipes. For instance, a material which has the necessary approval for drinking water and which can easily be displaced on the inner pipe can be selected for the conduit pipe. By way of example, use may be made of metal, such as Cuphin, a lead-free copper material or plastic, such as PA, for the inner pipe and/or for the conduit pipe. The material of the casing pipe can be selected substantially solely on the basis of its optical appearance. By way of example, use may be made of metal, such as chrome steel or brass or plastic, ceramic or wood. The wall thickness of the casing material may be relatively small, since practically no significant loads have to be absorbed by the casing pipe. By way of example, wall thicknesses of 0.5, 1, 1.5 or 2 millimetres are possible.

In one embodiment, the outer pipe comprises a connection end which surrounds the inner pipe, wherein the outer pipe comprises an outlet end which is opposite the connection end and on which an operating element is provided. By way of example, the operating element can be used to turn the water on and off and/or to adjust the amount of water and/or to adjust the temperature.

In one embodiment at least one water connection is provided on the connection plate, and in another embodiment the connection unit comprises two, three or more water connections and a mixing unit, wherein two of the water connections are connected to the mixing unit. Usually two water connections are provided, wherein one is a cold water connection and one is a hot water connection. Further connections may be provided for filtered water, disinfectants, boiling water or sparkling water.

In one embodiment, the connection unit comprises a display unit which is substantially flush with the bezel. By way of example, the temperature or the outflow duration may be displayed on the display unit. Alternatively, the current flow rate or the integration of flow programs, such as for example for hygiene, cleaning or the like, may also be displayed for example.

The aforementioned embodiments of the water outlet can be combined with one another at will in so far as they do not contradict one another.

BRIEF DESCRIPTION OF THE FIGURES

Exemplary embodiments of the present invention will be explained in greater detail below with reference to figures. These serve solely for explanation purposes and are not to be interpreted as limiting. In the figures.

DETAILED DESCRIPTION OF THE INVENTION

Figure 1:
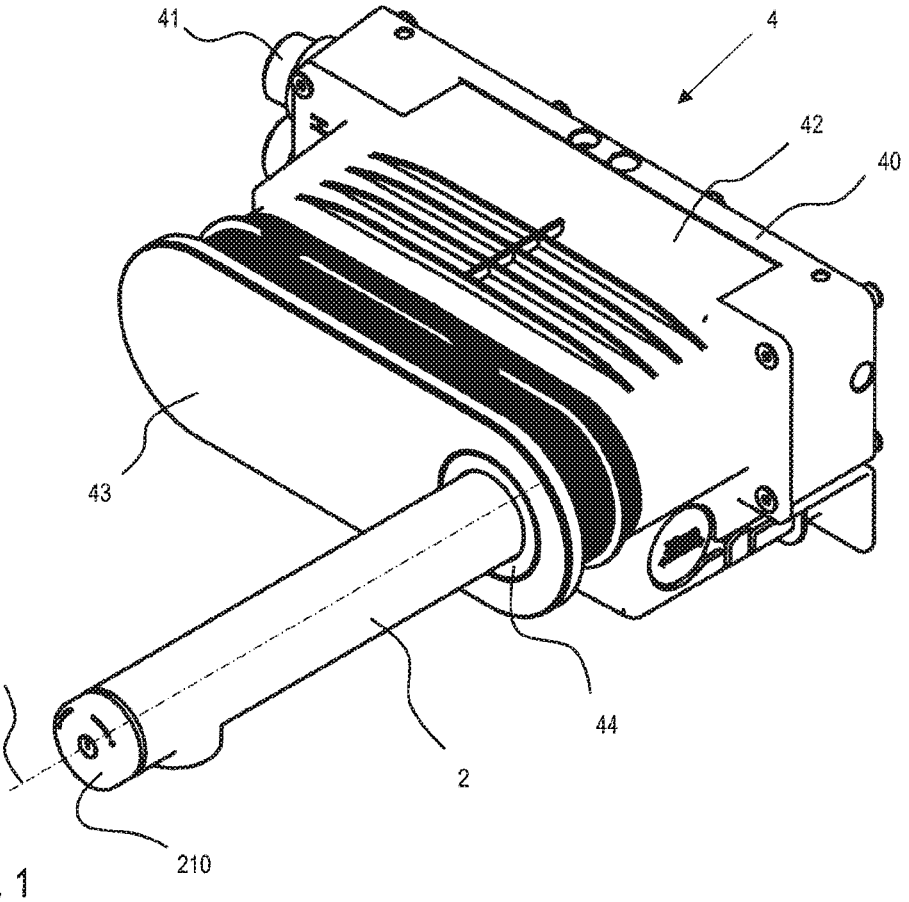
FIG. 1 shows a schematic perspective view of a water outlet according to the invention.

FIG. 1 shows a schematic perspective view of a water outlet according to the invention. The water outlet comprises a connection unit 4 with two connections 41, for example for hot and cold water. The connection unit 4 additionally comprises a mixing unit 42, in which hot and cold water can be mixed with one another. A bezel 44 is provided on the side of the connection unit 4 that is directed towards a user in the use position, said bezel surrounding an outer pipe 2. The bezel 44 is integrated in a display 43 and is recessed into the latter so as to be substantially flush therewith. An operating element 210 is arranged at the outlet end of the outlet pipe 2, which operating element is rotatable about a pipe longitudinal axis L. The operating element 210 can for example be pressed once in order to turn on the water. The outflow amount can be changed by pressing repeatedly or by pressing for a longer duration. The water temperature can be changed by rotating the operating element 210 in the clockwise direction or in the counterclockwise direction.

Figure 2:
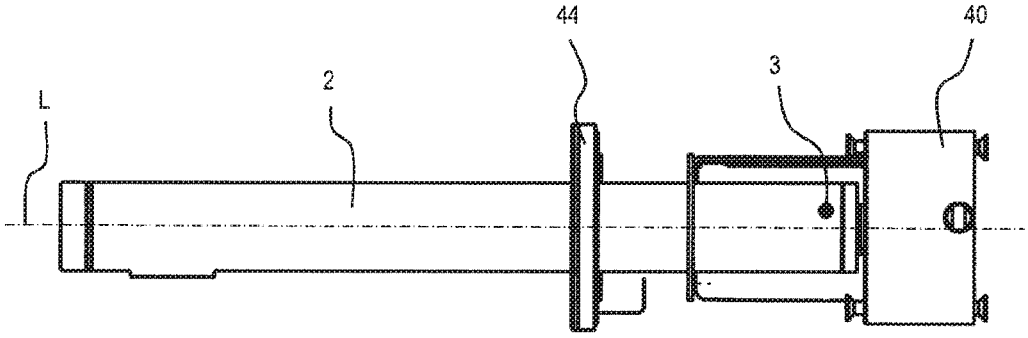
FIG. 2 shows a side view of the water outlet of FIG. 1, without the housing of the mixing unit.

FIG. 2 shows a side view of the water outlet of FIG. 1, without the housing of the mixing unit 42. A fixing means 3 in the form of a screw is provided on the outer pipe 2. The screw 3 can be turned in a threaded bore provided for this purpose in the outer pipe 2. If the screw 3 is loosened, the outer pipe 2 can be displaced on the inner pipe 1 along the longitudinal axis L such that the screw 3 comes to lie between the connection plate 40 and the bezel 44.

Figure 3:
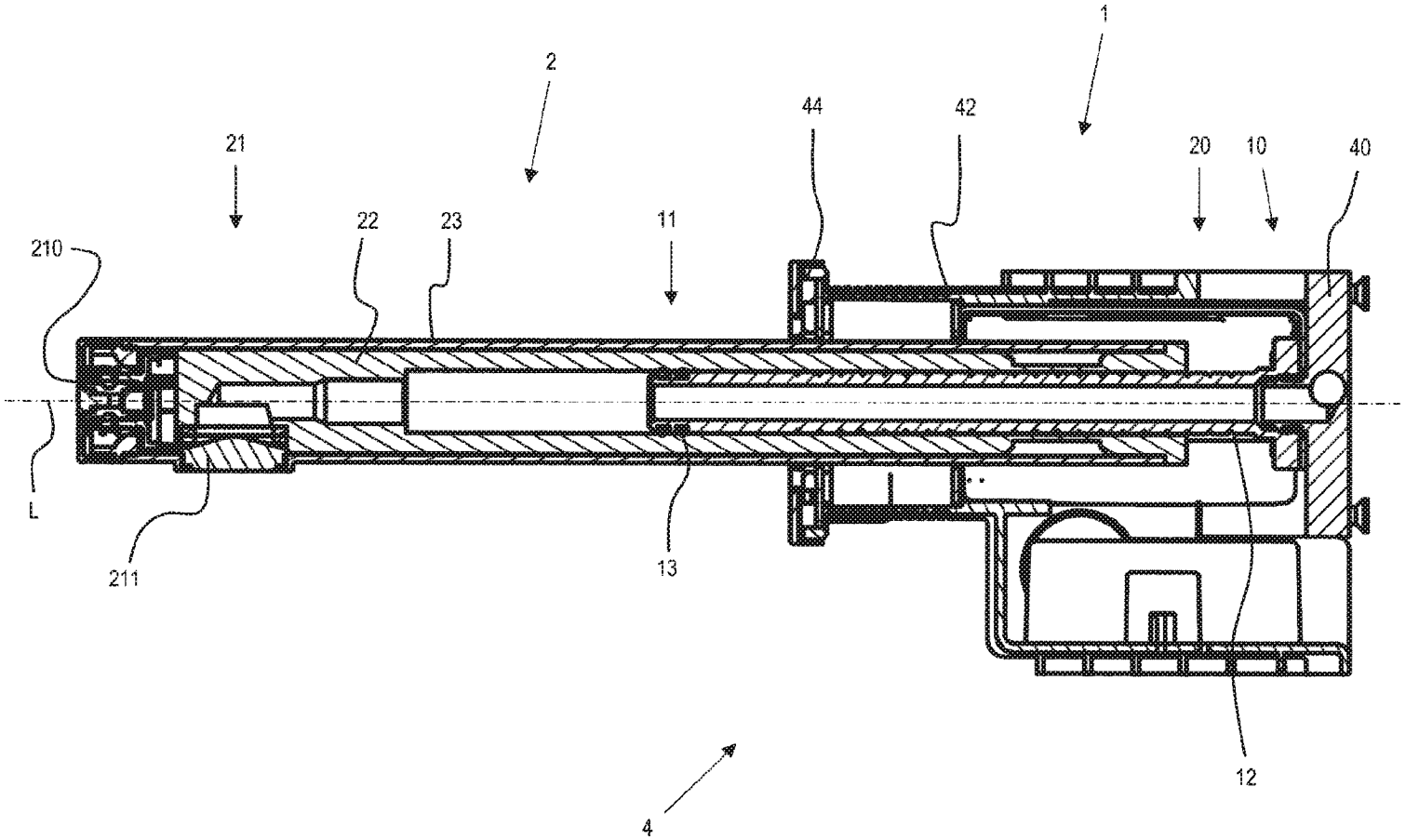
FIG. 3 shows a sectional side view of the water outlet of FIG. 1 through the longitudinal axis.

FIG. 3 shows a sectional side view of the water outlet of FIG. 1 through the longitudinal axis L of the outflow pipe. In the intended use position, the inner pipe 1 is arranged on a side of the connection plate 40 of the connection unit 4 that is directed towards a user. In the embodiment shown, the inner pipe 1 is screwed onto a threaded sleeve that is arranged on the connection plate 40. At its connection end 10, the inner pipe 1 comprises a thickened area and an end flange. A threaded bore extends through the flange and the thickened area in the region of the connection end 10. The inner pipe 1 comprises a plurality of circumferential grooves 12 which are arranged next to the thickened area in a manner spaced apart from one another along the longitudinal axis L on the circumference of the inner pipe. In the assembled state, the circumferential grooves are evenly distributed in a region next to the thickened area and as far as the bezel 44. Two sealing grooves are provided at an outflow end 11 of the inner pipe 1 which is opposite the connection end 10, said sealing grooves being spaced apart from one another and having a seal 13 provided in each case therein. The seals shown are O-rings. However, other commercially available round seals can also be used. The outer pipe 2 comprises a conduit pipe 22 which is displaceable along the longitudinal axis L with its inner diameter on the outer diameter of the inner pipe 1. The inner diameter is defined by a bore which extends from a connection end of the outer pipe 2 towards an outlet end 21. The conduit pipe 22 is closed in the outermost region of the outlet end 21. A lateral opening is provided in the conduit pipe 22, through which the water can flow out of the outer pipe. The conduit pipe 22 is partially surrounded by a casing pipe 23. The conduit pipe 22 has, on the connection side thereof, a circumferential collar against which the casing pipe 23 bears. The casing pipe extends beyond the closed end of the conduit pipe 222. The operating element 210 is recessed into the part of the casing pipe 23 that projects beyond the conduit pipe 22. The operating element 210 comprises a push button and a rotary knob. The lateral opening in the conduit pipe 22 is surrounded by a collar of the casing pipe 23. A threaded bore is provided in the lateral opening, into which a jet regulator 211 can be screwed. A mixing unit 42 having a closed housing is arranged on the side of the connection plate 40 that is directed towards the user. The bezel 44 is arranged on the side of the housing of the mixing unit 42 that faces towards the user. Hot water and cold water can pass from the respective connection 41 through a respective conduit to the mixing unit 42, and from there via a common conduit via the connection plate 40 into the inner pipe 1 and from the inner pipe 1 via the outer pipe 2 and the jet regulator 211 into a region below the outlet end 21 of the outer pipe 2.

LIST OF REFERENCE SIGNS

1 inner pipe
10 connection end
100 flange
101 thread
11 outflow end
12 circumferential groove
13 seal
2 outer pipe
20 connection end
21 outlet end
210 operating element
211 jet regulator
22 conduit pipe
23 casing pipe
3 fixing means
4 connection unit
40 connection plate

41 connection
42 mixing unit
43 display
44 bezel
L longitudinal axis

The invention claimed is:

1. A water outlet for installation in a recess in a wall, comprising an inner pipe (1) designed as a throughflow pipe, an outer pipe (2) designed as an outflow pipe, wherein the outer pipe (2) is directly mounted on the inner pipe (1) and at least partially surrounds the inner pipe (1), and a connection unit (4), wherein the connection unit (4) comprises a connection plate (40) and a bezel (44), wherein the inner pipe (1) is arranged on the connection plate (40), and wherein the bezel (44) is arranged around the outer pipe (2) at a distance from the connection plate (40), characterized in that the outer pipe (2) is displaceable along its longitudinal axis (L), and in that a fixing means (3) is provided, by which a previously adjusted relative position between the inner pipe (1) and the outer pipe (2) can be fixed, wherein the fixing means (3) is arranged on the outer pipe (2) between the connection plate (40) and the bezel (44).

2. The water outlet according to claim 1, wherein circumferential grooves (12) are provided on the outer circumference of the inner pipe (1), which circumferential grooves are arranged in a manner spaced apart from one another along the longitudinal axis (L), and wherein the fixing means (3) can engage in the grooves (12).

3. The water outlet according to claim 1, wherein at least one longitudinal groove (13) is provided along the outer circumference of the inner pipe (1), and wherein at least one protrusion (220) is provided on the inner circumference of the outer pipe (2), which protrusion can be guided in the longitudinal groove (13).

4. The water outlet according to claim 1, wherein at least one seal (14) is provided between the inner pipe (1) and the outer pipe (2).

5. The water outlet according to claim 1, wherein the outer pipe (2) comprises a conduit pipe (22) and a casing pipe (23) which at least partially surrounds the conduit pipe (22).

6. The water outlet according to claim 1, wherein the outer pipe (2) comprises a connection end (20) which surrounds the inner pipe (1), and wherein the outer pipe (2) comprises an outlet end (21) which is opposite the connection end (20) and on which an operating element (210) is provided.

7. The water outlet according to claim 1, wherein at least one water connection (41) is provided on the connection plate (40).

8. The water outlet according to claim 1, wherein the connection unit (4) comprises two, three or more water connections (41) and a mixing unit (42), wherein two of the water connections (41) are connected to the mixing unit (42).

9. The water outlet according to claim 1, wherein the connection unit (4) comprises a display unit (43) which is substantially flush with the bezel (44).

* * * * *